US008984889B2

(12) United States Patent
Wilbraham

(10) Patent No.: US 8,984,889 B2
(45) Date of Patent: Mar. 24, 2015

(54) COMBUSTOR FOR A GAS-TURBINE ENGINE WITH ANGLED PILOT FUEL NOZZLE

(75) Inventor: Nigel Wilbraham, Stourbridge (GB)

(73) Assignee: Siemens Aktiengesellschaft, Munich (DE)

( * ) Notice: Subject to any disclaimer, the term of this patent is extended or adjusted under 35 U.S.C. 154(b) by 1108 days.

(21) Appl. No.: 12/740,802

(22) PCT Filed: Oct. 8, 2008

(86) PCT No.: PCT/EP2008/063435

§ 371 (c)(1), (2), (4) Date: Apr. 30, 2010

(87) PCT Pub. No.: WO2009/056425

PCT Pub. Date: May 7, 2009

(65) Prior Publication Data

US 2010/0293953 A1 Nov. 25, 2010

(30) Foreign Application Priority Data

Nov. 2, 2007 (GB) ..... 0721577.5

(51) Int. Cl.

*F23R 3/28* (2006.01)
*F23R 3/14* (2006.01)
*F23R 3/34* (2006.01)

(52) U.S. Cl.

CPC . *F23R 3/343* (2013.01); *F23R 3/14* (2013.01); *F23R 3/286* (2013.01)
USPC ..... 60/748; 60/737; 60/740

(58) Field of Classification Search

CPC ..... F23R 3/343; F23R 3/28; F23R 3/14; F23R 3/286
USPC ..... 60/740, 737, 742, 747, 748, 746
See application file for complete search history.

(56) References Cited

U.S. PATENT DOCUMENTS

| | | | | |
|---|---|---|---|---|
| 2,687,010 A | | 8/1954 | Ellis | |
| 3,452,933 A | * | 7/1969 | Hakluytt | 239/399 |
| 3,730,438 A | | 5/1973 | Howe | |
| 3,851,462 A | * | 12/1974 | Vranos | 60/776 |
| 4,991,398 A | | 2/1991 | Clark et al. | |
| 5,088,287 A | | 2/1992 | Shekleton | |
| 5,263,316 A | * | 11/1993 | Shekleton | 60/804 |
| 5,267,442 A | | 12/1993 | Clark | |
| 5,596,873 A | * | 1/1997 | Joshi et al. | 60/738 |
| 6,360,525 B1 | | 3/2002 | Senior et al. | |

(Continued)

FOREIGN PATENT DOCUMENTS

| | | |
|---|---|---|
| JP | 62138613 A | 6/1987 |
| JP | 6213452 A | 8/1994 |

(Continued)

*Primary Examiner* — William H Rodriguez
*Assistant Examiner* — Carlos A Rivera

(57) ABSTRACT

A combustor for a gas-turbine engine including a burner head, a combustion chamber disposed downstream of the burner head, a swirler for creating a swirling flow of air in the combustion chamber, and a fuel nozzle disposed in the burner head. The fuel nozzle is disposed giving rise to a first angle of exit of the fuel from a downstream face of the burner head of >±0° with respect to a longitudinal axis of the combustor, this first angle lying in a first plane passing through the longitudinal axis. The fuel also exits at a second angle from the downstream face of >±0° with respect to the first plane, the second angle lying in a second plane orthogonal to the first plane.

16 Claims, 16 Drawing Sheets

(56) References Cited

U.S. PATENT DOCUMENTS

| | | | | |
|---|---|---|---|---|
| 6,532,726 | B2 | 3/2003 | Norster et al. | |
| 6,622,488 | B2 * | 9/2003 | Mansour et al. | 60/740 |
| 6,662,565 | B2 | 12/2003 | Brundish et al. | |
| 6,772,594 | B2 * | 8/2004 | Nishida et al. | 60/737 |
| 7,972,133 | B2 * | 7/2011 | Bernero et al. | 431/278 |
| 2001/0027637 | A1 | 10/2001 | Norster et al. | |
| 2002/0088234 | A1 | 7/2002 | Brundish et al. | |
| 2004/0035114 | A1 * | 2/2004 | Hayashi et al. | 60/737 |
| 2005/0173566 | A1 | 8/2005 | Vecchiet et al. | |
| 2006/0042254 | A1 | 3/2006 | Yoshida et al. | |
| 2007/0006587 | A1 | 1/2007 | Ohta et al. | |

FOREIGN PATENT DOCUMENTS

| | | | |
|---|---|---|---|
| RU | 2062405 | C1 | 6/1996 |
| RU | 2157954 | C2 | 10/2000 |
| WO | 2007/110298 | A1 | 10/2007 |

* cited by examiner

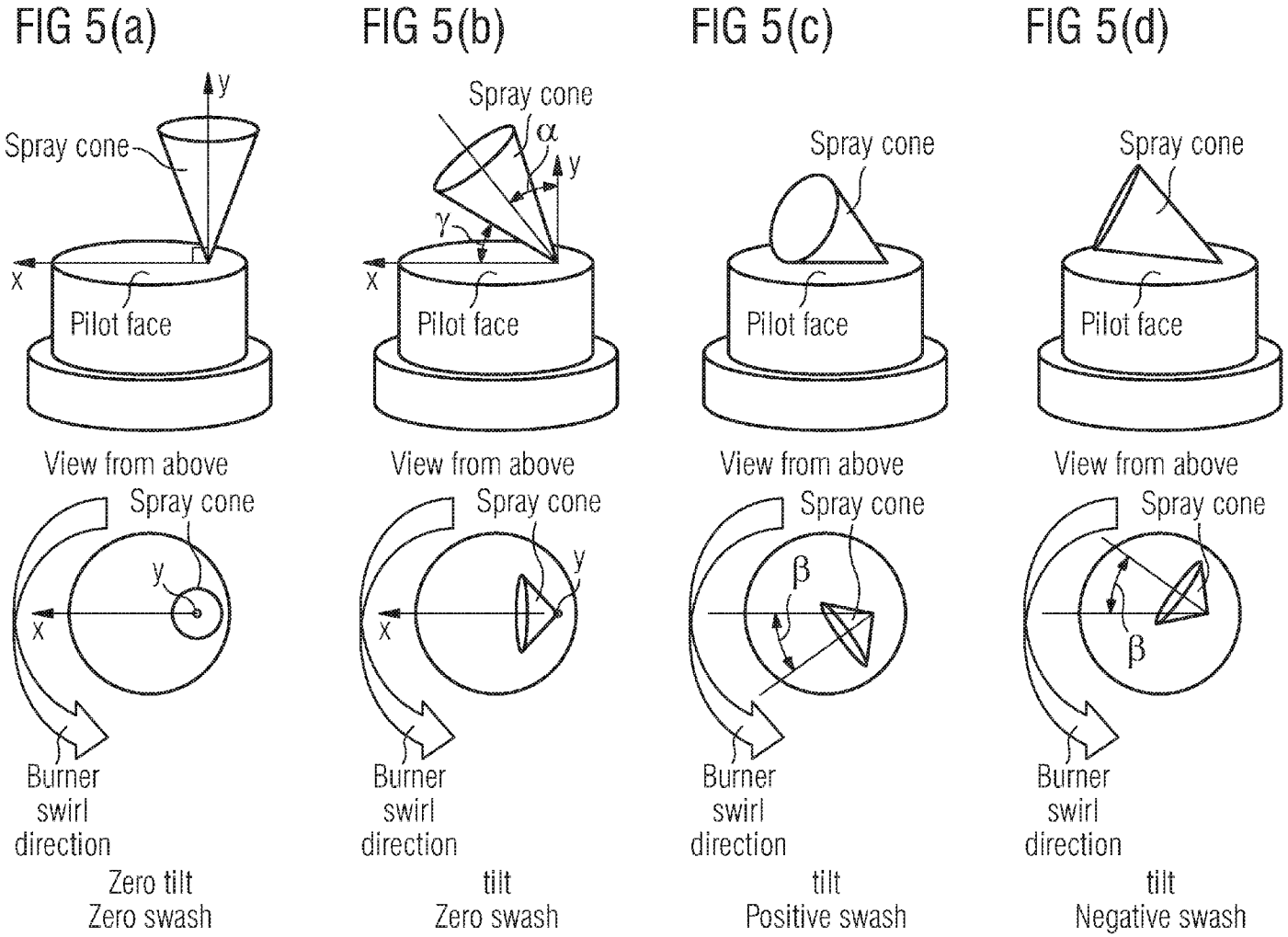
FIG 5(a)
Spray cone
y
x
Pilot face
View from above
Spray cone
y
x
Burner swirl direction
Zero tilt
Zero swash
FIG 5(b)
Spray cone
α
y
γ
x
Pilot face
View from above
Spray cone
y
x
Burner swirl direction
tilt
Zero swash
FIG 5(c)
Spray cone
Pilot face
View from above
Spray cone
β
Burner swirl direction
tilt
Positive swash
FIG 5(d)
Spray cone
Pilot face
View from above
Spray cone
β
Burner swirl direction
tilt
Negative swash

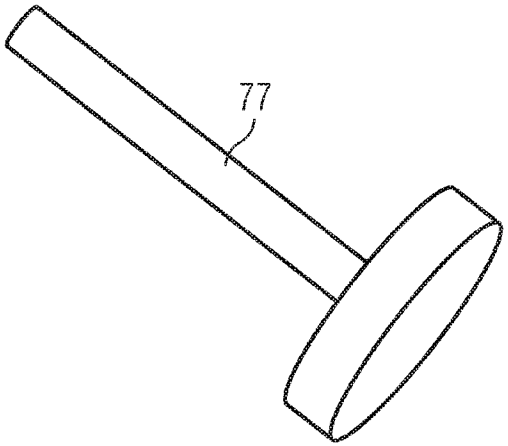
FIG 8(c)
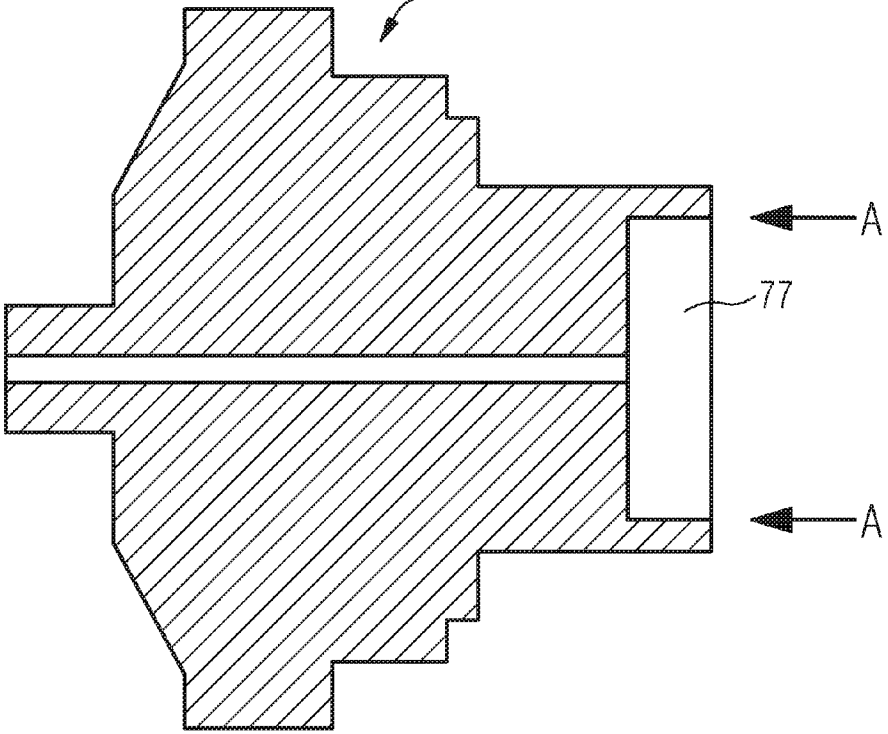
FIG 8(b)
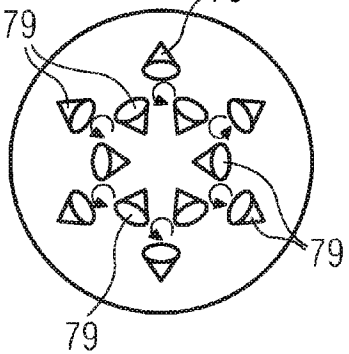
FIG 8(d) A-A

COMBUSTOR FOR A GAS-TURBINE ENGINE WITH ANGLED PILOT FUEL NOZZLE

CROSS REFERENCE TO RELATED APPLICATIONS

This application is the US National Stage of International Application No. PCT/EP2008/063435, filed Oct. 8, 2008 and claims the benefit thereof. The International Application claims the benefits of Great Britain application No. 0721577.5 DE filed Nov. 2, 2007. All of the applications are incorporated by reference herein in their entirety.

FIELD OF INVENTION

The invention relates to a combustor for a gas-turbine engine.

BACKGROUND OF INVENTION

It is a common desire in gas-turbine technology to increase the efficiency of combustion of the fuel-air mixture employed in such engines. It is also desirable to be able to obtain a good mix between fuel and air, which is not greatly dependent on the load, which is placed on the engine.

Various measures have been invented to enhance the fuel-air mixing process. One such is disclosed in U.S. Pat. No. 4,991,398, issued to assignee United Technologies Corporation. FIGS. 1(*a*) and 1(*b*) show a basic principle of a technique described in this patent. An annular combustor 10 has disposed at a dome end 12 thereof a number of fuel nozzles 14. The nozzles 14 are circumferentially spaced apart in two rows—a first, radially inner row 16 and a second, radially outer row 18, referred to a longitudinal axis 20 of the combustor. The nozzles of one row interleave with those of the other row, so as to create a triangular configuration shown as G in FIG. 1(*a*). Each of the nozzles has its own swirler device and the directions of the swirl in each case are shown by the arrows 24. Combustion air is introduced into the combustion chamber at an axially intermediate point 22.

As can be seen in FIG. 1(*b*), the fuel spray 26 (nominally in the form of a cone) emanating from the nozzles in row 18 interleaves with the fuel spray 28 emanating from the nozzles in row 16, the result being a mutual reinforcement of the two flows. Because of this reinforcement, the fuel tends to be distributed more uniformly throughout the combustion chamber, and fuel-air mixing is more intense. Indeed, intense combustion starts quite close to the dome within distance C1, increasing the axial extent of the intense burning to distance E1, before the combustion becomes diluted. This enables the combustor to be made shorter in length, thereby saving space and weight.

A development of the arrangement just described is set out in U.S. Pat. No. 6,360,525, issued to Alstom Gas Turbines Ltd. In this patent (see FIGS. 2(*a*) and 2(*b*)) an annular combustor 30 has a similar arrangement of nozzles to that in U.S. Pat. No. 4,991,398, but this time the dome end 32 of the combustor is made in two radially adjacent sections, namely sections 32*a* and 32*b*, which are arranged at an angle 34 to each other at a mid-point 36 of the combustor. The two rows of nozzles 38 are provided in respective sections 32*a*, 32*b* and, since these sections are inclined with respect to the normal to the longitudinal axis 36, the spray cones 40, 42 emanating from the nozzles are radially inclined toward each other in an interleaving manner. The longitudinal centrelines 41, 43 of the spray cones leaving the nozzles cross each other at an axial point 44, which forms a circle over the whole annular combustor.

This mutual inclination of the two flows radially toward each other creates a stronger mixing action between the flows than is the case in the FIG. 1 arrangement. This, in turn, enhances the uniformity of combustion in the primary combustion zone. In addition the distance C1 in FIG. 1(*b*) is reduced, enabling the combustor to be further shortened in the axial direction.

SUMMARY OF INVENTION

In accordance with the invention there is provided a combustor for a gas-turbine engine, comprising: a burner head; a combustion chamber disposed downstream of the burner head; a swirler means for creating a swirling flow of air in the combustion chamber, and a fuel nozzle disposed in the burner head for supplying fuel to the combustion chamber; said fuel nozzle being disposed in the burner head such as to give rise to a first angle of exit of the fuel from a downstream face of the burner head of $>\pm 0°$ with respect to a longitudinal axis of the combustor, said first angle lying in a first plane passing through the longitudinal axis, and to give rise to a second angle of exit of the fuel from said downstream face of $>\pm 0°$ with respect to said first plane, said second angle lying in a second plane orthogonal to said first plane.

The nozzle may be configured such as to give rise to a generally cone-shaped spray of fuel entering the combustion chamber, an angle between a surface of the fuel cone and the downstream face being $>0°$.

The combustor may be a can-type combustor and the fuel nozzle may be disposed radially offset from the longitudinal axis of the combustor.

The first angle may be such that the fuel cone is inclined toward the longitudinal axis of the combustor.

There may be a plurality of the fuel nozzles.

The combustor may be an annular combustor comprising a plurality of the fuel nozzles disposed in circumferentially spaced apart manner. At least one of the fuel nozzles may be a pre-filmer device comprising a fuel duct, a swirler and a pre-filmer element, all of which are disposed at the first and second angles. At least one of the fuel nozzles may be a pressure-swirl injector device comprising a swirler and a fuel duct, both of which are disposed at the first and second angles. At least one of the fuel nozzles may be an air-blast injector device comprising two or more coaxially disposed swirlers and filming elements, all of which are disposed at the first and second angles.

One or more further fuel nozzles may be disposed axially downstream of the fuel nozzles, the fuel nozzles being disposed such as to direct a flow of fuel toward respective further fuel nozzles.

The combustor may further comprise one or more further fuel nozzles disposed in the burner head radially inwardly or radially outwardly of the fuel nozzles, the fuel nozzles being disposed such as to direct a flow of fuel toward respective further fuel nozzles.

The fuel nozzle in the various embodiments of the invention may be a pilot-fuel nozzle.

BRIEF DESCRIPTION OF THE DRAWINGS

Embodiments of the invention will now be described, by way of example only, with the aid of the appended drawings, of which:

FIGS. 5(*a*)-5(*d*) are perspective and plan views of four different injector configurations in the combustor of FIGS. 4(*a*) and 4(*b*);

DETAILED DESCRIPTION OF INVENTION

Figure 3A:
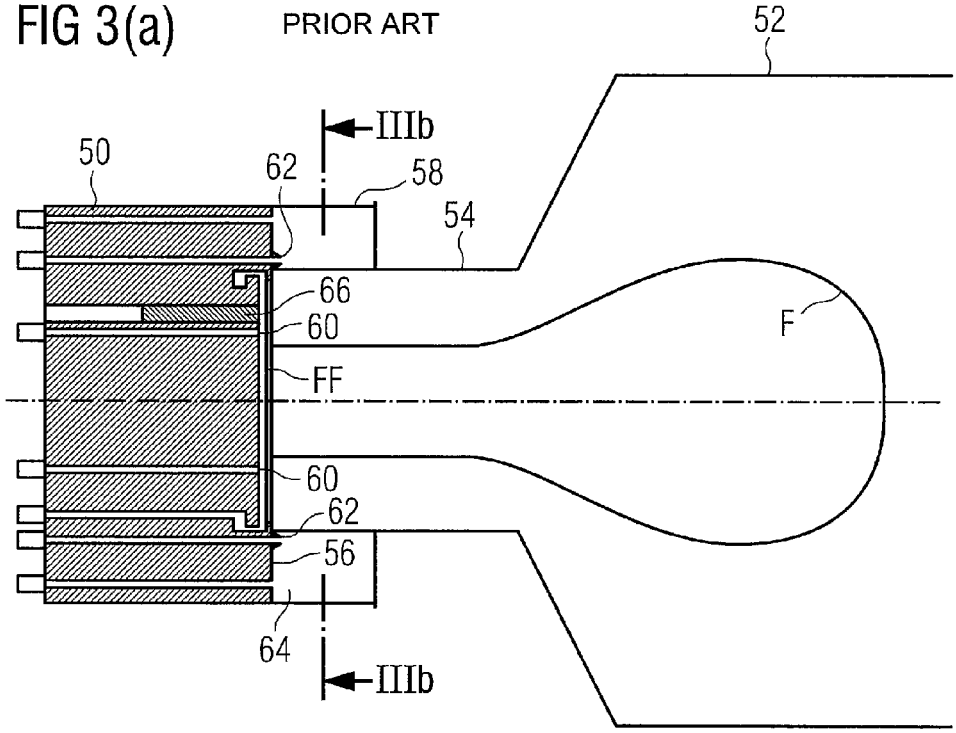
FIG 3(a) PRIOR ART
FIGS. 3(*a*) and 3(*b*) are, respectively, a longitudinal section through a known can-type combustor and a radial section through a radial swirler employed in this combustor.
Figure 3B:
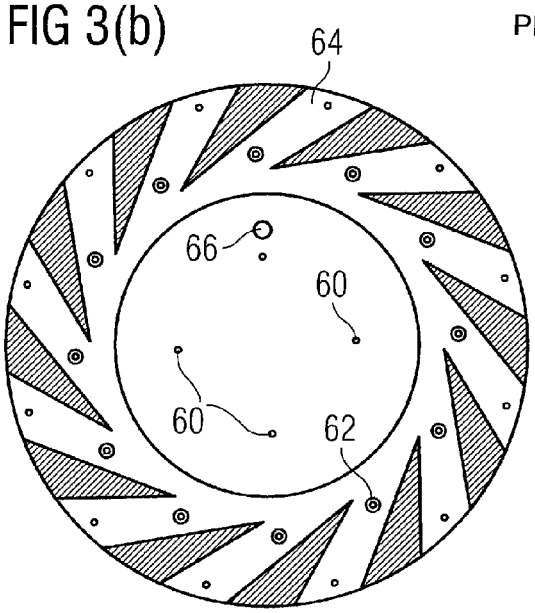
FIG 3(b) PRIOR ART

Turning now to FIG. 3(*a*) this is a longitudinal section through a can-type combustor described in U.S. Pat. No. 6,532,726, issued to Alstom Gas Turbines, Ltd, as assignee. FIG. 3(*b*) is a radial section through a radial swirler employed in this combustor. The combustor comprises a burner head 50 and a combustion chamber 52. The combustion chamber 52 narrows down into a pre-chamber 54 before being connected to a downstream face 56 of the burner head. A radial swirler 58 is disposed intermediate the burner face 56 and prechamber 54, and a number of pilot-fuel nozzles 60 and main-fuel nozzles 62 are provided in circumferentially spaced-apart manner in the burner head. In use, liquid fuel is supplied via the pilot-fuel nozzles 60, this fuel being mixed with compressed air entering the passages 64 of the swirler. The mixture is ignited by means of an igniter 66. Once the engine load has increased to a given level, main fuel is supplied via the main-fuel nozzles 62. This main fuel is then regulated to provide in the region of 95% of the total engine fuel requirement. The ignited flame is shown in FIG. 3(*a*) as a flame front F and a flame front-face FF adjacent the burner face 56.

Figure 4A:
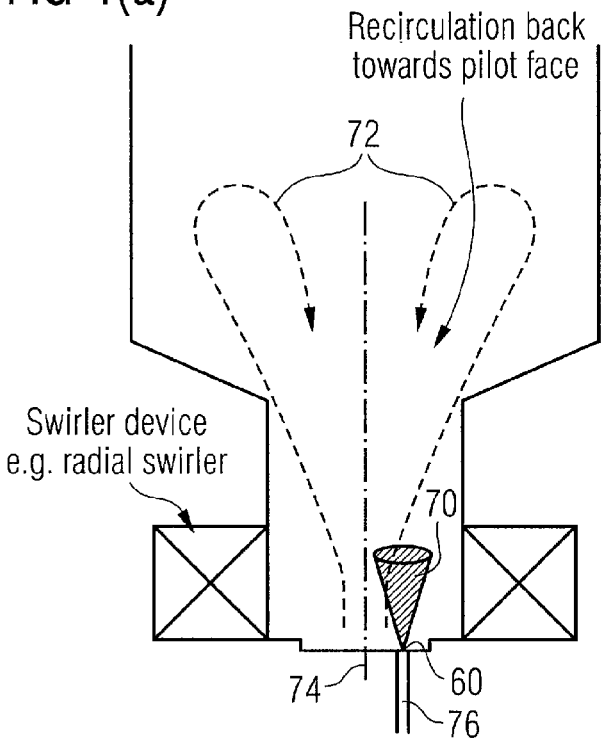
FIG 4(a) PRIOR ART
FIG. 4(*a*) is a simplified longitudinal section through the combustor of FIGS. 3(*a*) and 3(*b*), while 4(*b*) is a longitudinal section through a combustor in accordance with a first embodiment of the present invention.
Figure 4B:
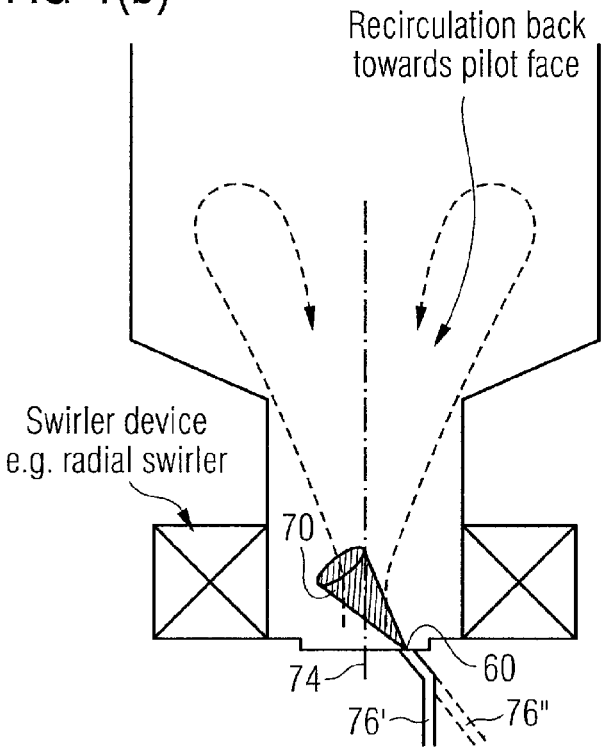
Figure 6A:
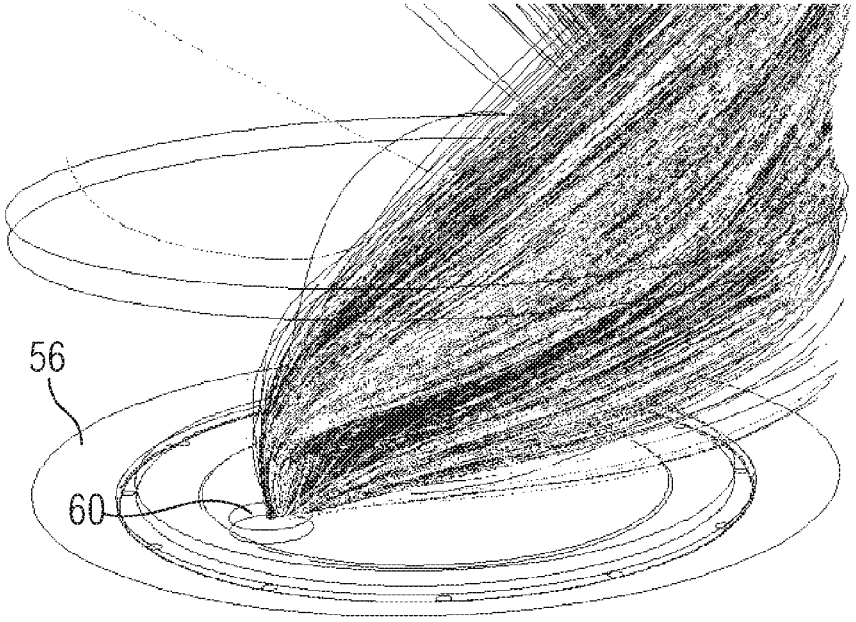
FIGS. 6(*a*) and 6(*b*) are results of a computer simulation of two different configurations of the combustor in accordance with the first embodiment, while FIGS. 6(*c*) and 6(*d*) are simplified representations of FIGS. 6(*a*) and 6(*b*), respectively.
Figure 6B:
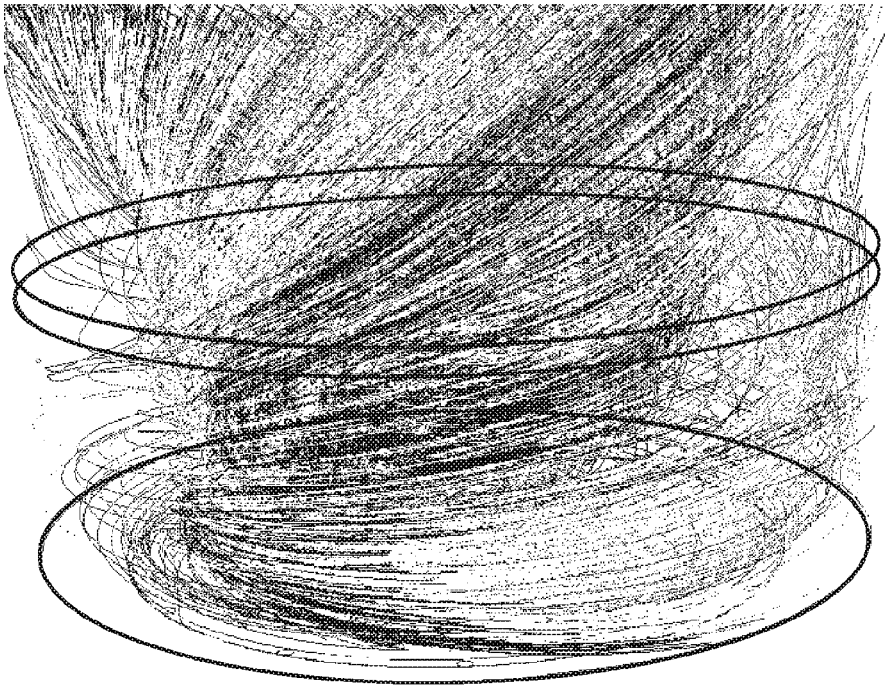
Figure 6C:
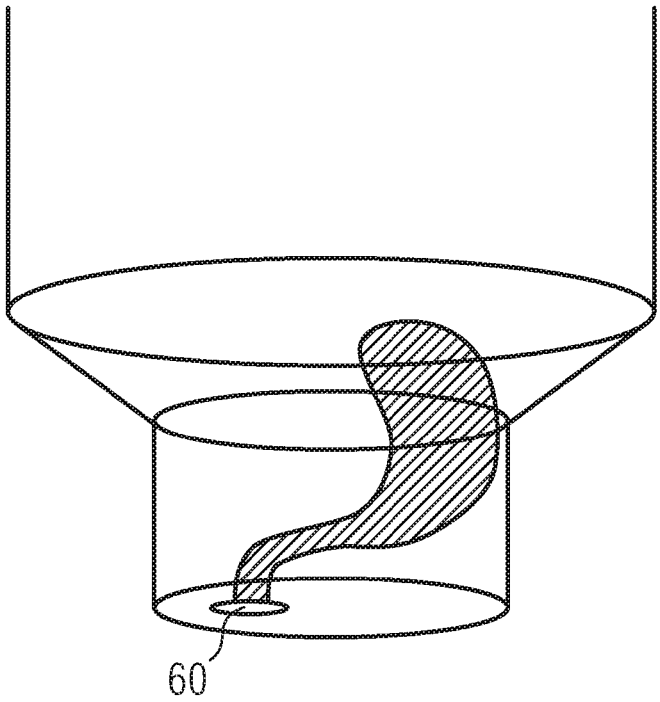
Figure 6D:
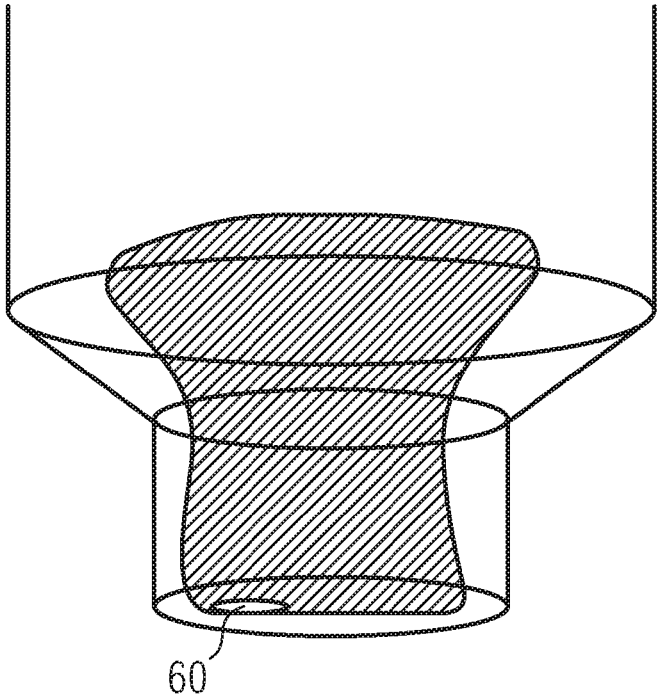

The present invention, in a first embodiment thereof, retains the use of only one of the pilot nozzles shown in FIGS. 3(*a*) and 3(*b*) and changes its configuration in a manner shown in FIGS. 4(*a*) and 4(*b*). FIGS. 4(*a*) and 4(*b*) are a simplified representation of FIG. 3(*a*), in which the radial swirler 58 and pre-chamber/combustion chamber combination, 54/52, are shown, but not the burner head 50. Emerging from the pilot nozzle 60 is a cone-shaped spray of pilot fuel 70. This spray is injected into the base of a recirculating-air region of the burner, shown by the dashed lines 72. The recirculation region is a region of the combustor, in which the combustion products lose their momentum and are drawn back into the radially central part of the combustor by a low-pressure region created by the swirling action of the swirler. It is noted that the pilot-fuel nozzle 60 is positioned off-centre with respect to the longitudinal axis 74 of the burner. This is beneficial for the control of the nozzle temperature. However, in the design shown in FIG. 4(*a*), which corresponds to the FIG. 3 arrangement, the off-centred nature of the spray can result in a large proportion of the spray missing the recirculation region, where the main combustion reaction takes place. This has the drawback that the resultant unreacted fuel-spray droplets leave the combustor in the form of unburnt hydrocarbons.

The solution provided by the present invention is to reconfigure the nozzle 60 so as to direct the cone-shaped spray toward the longitudinal axis 74 of the burner and combustor. To achieve this, the duct 76 forming part of the nozzle is angled, as shown in FIG. 4(*b*). Either only the end portion of the duct adjacent the burner face is angled, in which case the rest of the duct can follow a path normal to the burner face (see duct portion 76'), or the whole duct is angled (see dotted line portion 76").

Examples of the possible orientations that may be assumed by the spray cone are shown in FIGS. 5(*a*)-5(*d*). The unslanted spray cone of FIG. 4(*a*) is shown in FIG. 5(*a*), while the slanted spray cone of FIG. 4(*b*) is shown in FIG. 5(*b*). In FIG. 5(*a*), the major axis of the cone lies along the y-axis, while the burner face lies along the x-axis of an x, y coordinate system. In FIG. 5(*b*), on the other hand, the major axis of the cone lies at an angle $\alpha$ to the y-axis, whereby the spray from the nozzle is directed toward the centre of the recirculation region.

In addition to a tilting of the nozzle toward the longitudinal axis of the combustor, the nozzle is also subjected to rotation in a plane orthogonal to the plane in which the x, y coordinates lie, namely the plane of the burner face. This is illustrated in FIGS. 5(*c*) and 5(*d*). In FIG. 5(*c*), the cone is rotated so that it makes an angle $\beta$ with the x-axis in the same direction as the swirl direction of the air emanating from the swirler, whereas in FIG. 5(*d*) the angle $\beta$ is in the opposite direction, i.e. against the swirl direction. In what follows, rotation of the cone with the swirl direction will be called "positive swash", while rotation against the swirl direction will be called "negative swash". Incidentally, the angle $\alpha$ in FIGS. 5(*c*) and 5(*d*) is greater than that in FIG. 5(*b*), although it could just as well have been smaller or the same.

The effects of this "tilt" and "swash" technique are shown in FIGS. 6(*a*) and 6(*b*), which are the results of a computer simulation. The simulations include the burner face 56 and nozzle 60 (the latter can be seen in FIG. 6(*a*) only), and the fuel exiting the nozzle can be seen being caught up in the swirling action created by the swirler. The lighter coloured swirl lines represent liquid fuel droplets, which are smaller than those represented by the heavier coloured swirl lines. It can be seen how the heavier (i.e. larger) droplets are less affected by the swirl action and therefore tend to keep to the areas around the burner axis, while the lighter droplets are flung further afield. FIGS. 6(*c*) and 6(*d*) correspond to FIGS. 6(*a*) and 6(*b*), respectively, but in simplified form, in which just the outline shape of the fuel-air mixture is shown. In FIGS. 6(*a*) and 6(*c*) the swash angle is positive, whereas in FIGS. 6(*b*) and 6(*d*) it is negative. It can be clearly seen that there is significantly more mixing of the fuel droplets with the incoming air in FIGS. 6(*b*) and 6(*d*) than in FIGS. 6(*a*) and 6(*c*). However, in both cases there is improved fuel dispersion throughout the pre-chamber. This increases the efficiency of the combustion process, since the variability in the concentration of fuel in the central recirculation zone and in the main combustor dome expansion regions is reduced. Furthermore, the burning processes in the combustor dome recirculation regions are more circumferentially uniform, resulting in a longer combustor life.

Positive and negative swash bring different advantages in terms of combustor performance. As already mentioned, positive swash will result in poorer dispersal of fuel compared with the negative swash. However, this can be beneficial for conventional or non-premixed combustor designs, since the poorer dispersal will ensure that there are locations where a high fuel concentration will exist. This, in turn, will provide an anchor for the flame. An application where this might prove useful is an aeroengine gas-turbine combustor application, where a situation of high water-ingestion may occur (e.g. the aircraft flies through heavy rain). In this event, it is still possible to achieve a degree of stability of the flame. On the other hand, negative swash is beneficial for low-emissions combustor designs. This is because the high shear and disruption of the fuel spray in the combustor gas stream will improve the fuel-to-air mixing process and minimise locations of high fuel-concentration. High concentrations of fuel can give rise to stoichiometric burning, which in turn produces high emissions of NOx.

Returning momentarily to FIG. 5(*b*), in this diagram an angle $\gamma$ is shown, this being the angle between the surface of the cone and the burner face. It is preferred that this angle not equal 0°, because a 0° angle will result in large amounts of fuel coming into contact with the combustor surfaces, which is not desirable, since such fuel cannot contribute to combustion and also tends to form carbon or "coke" deposits on the burner face.

Although the nozzles in the first embodiment have been described in connection with the supply of pilot fuel, they may equally be nozzles for supplying main fuel.

Figures 7A, 7B:
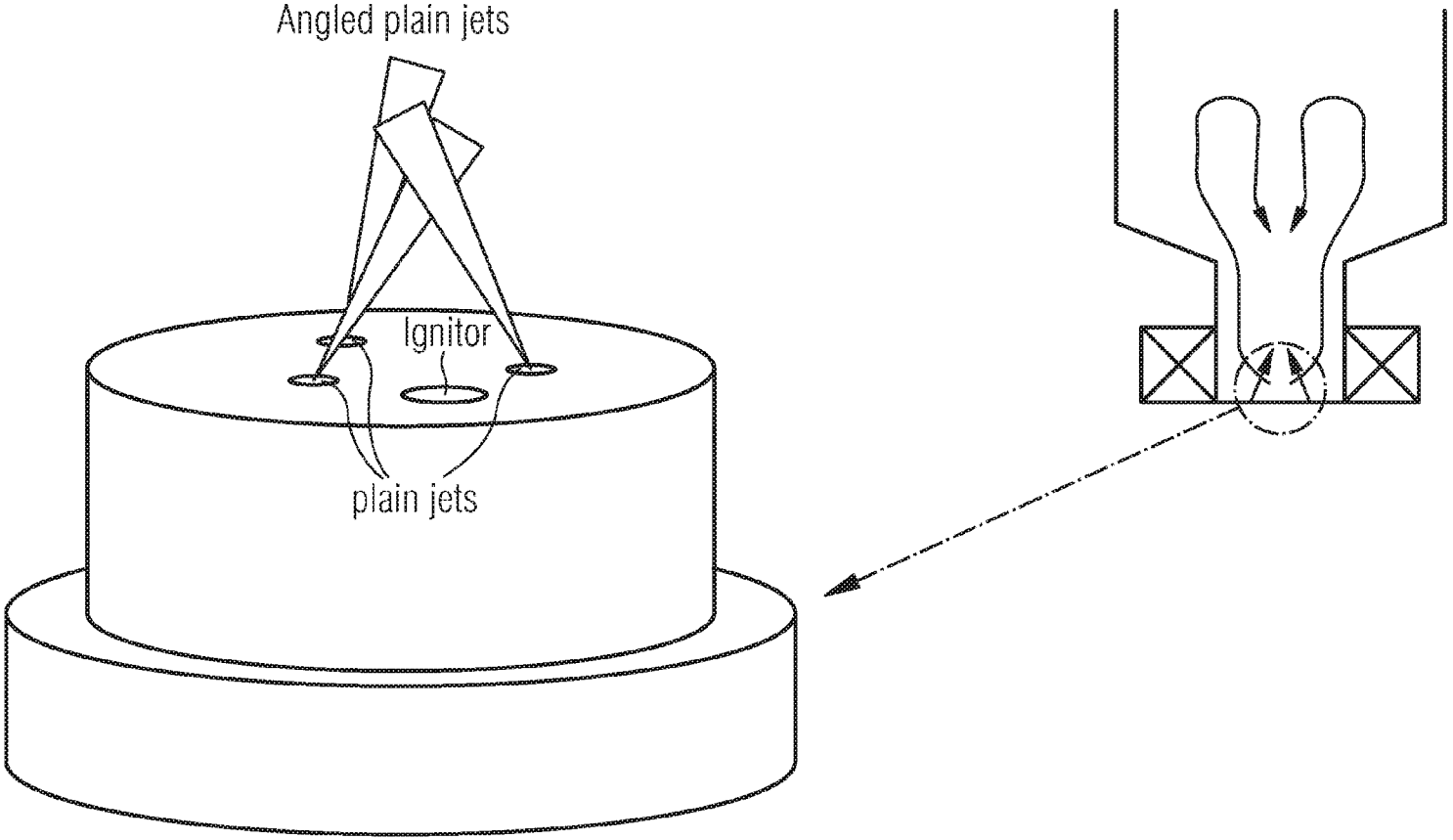
FIGS. 7(*a*) and 7(*b*) are perspective and longitudinal sections, respectively, of a combustor in accordance with a second embodiment of the present invention.

A second embodiment of the invention will now be described with reference to FIGS. 7(*a*) and 7(*b*). FIG. 7(*a*) is a development of the first embodiment, in which, instead of employing just one nozzle, two or more are used in conjunction with each other. In the FIG. 7(*a*) example there are three such nozzles approximately equidistantly spaced around the burner face. Each of the nozzles is inclined toward the centreline (longitudinal axis) of the burner/combustor arrangement by the same tilt angle, but at the same time the nozzles are rotated by the same swash angle. This is shown in a simplified longitudinal section in FIG. 7(*b*), where the arrows rising obliquely from the burner face represents the fuel flow toward the central region of the combustor. Incidentally, FIG. 7(*b*) could also be interpreted as a two-nozzle system, in which case the nozzles will normally be spaced 180° apart.

The nozzles in FIGS. 7(*a*) and 7(*b*) are plain nozzles formed in the burner head, along the lines of those shown in the known combustor arrangement of FIGS. 3(*a*) and 3(*b*). That is, they are not associated with their own swirler or, e.g., pressure injection mechanism.

This embodiment of the invention may be also applied to combustors having a number of nozzles greater than three. For example, combustors with as many as twelve nozzles are not uncommon. As applied to the present invention, these nozzles would be as shown in FIG. 7(*a*), that is approximately equally spaced around the burner surface and subjected to approximately the same tilt and swash angles.

In both the FIG. 7 arrangement and its variant comprising a greater number of nozzles, the nozzles may be brought into service either together, or in sequence one after the other or in groups. When used sequentially, they may provide a staged combination of pilot and/or main fuel jets, controlled in dependence on the engine load, for example. When used all together simultaneously as either main or pilot fuel nozzles, the jets from the nozzles will interact with each other to create an enhanced mixing action between the liquid fuel and the air from the swirler in a radially central region of the combustion chamber.

Figure 8A:
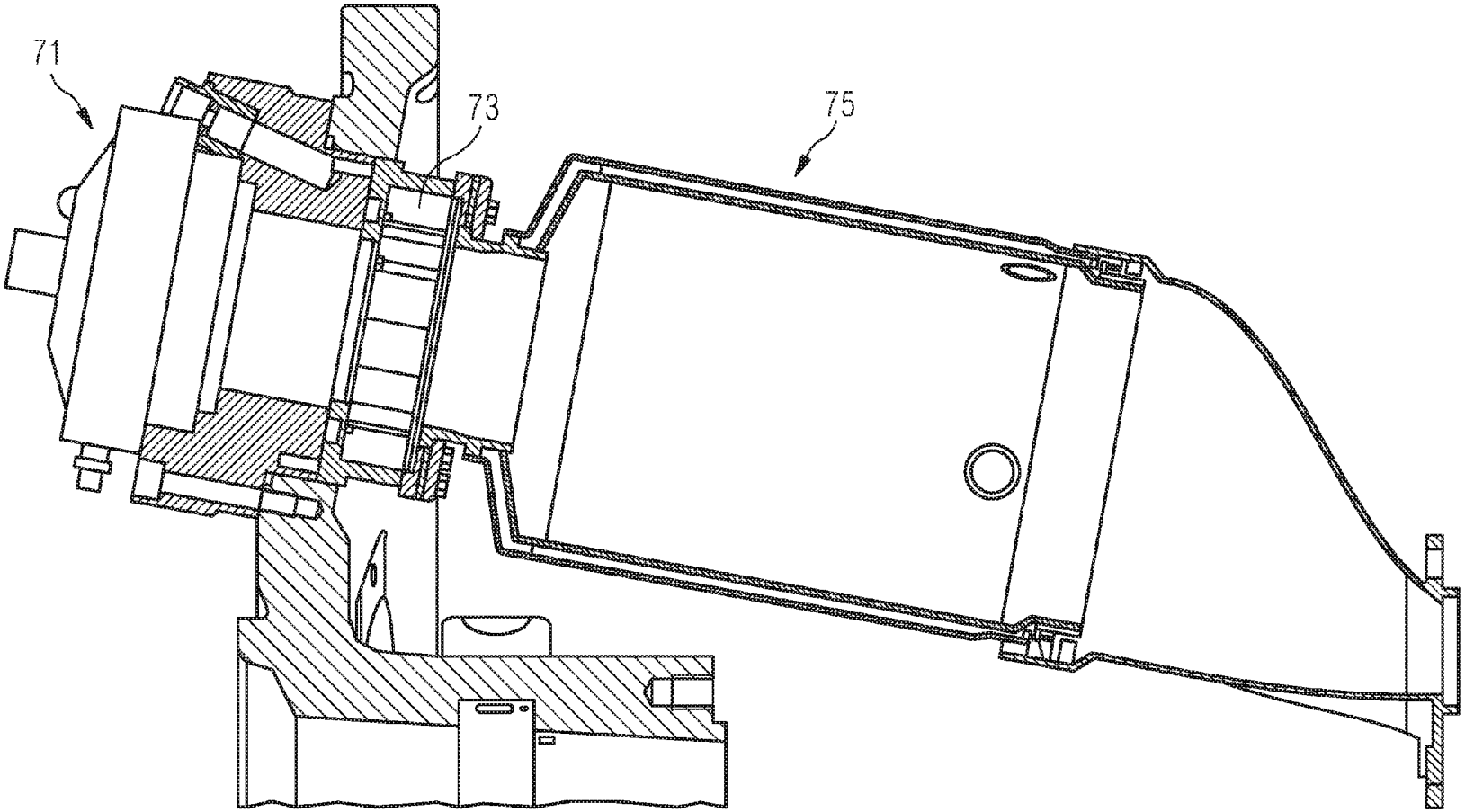
FIG. 8(*a*) is a longitudinal section through a variant of a combustor in accordance with the second embodiment, while FIGS. 8(*b*)-8(*d*) represent various component parts of this combustor.

A further variant of the invention as applied to a can-type combustor is shown in FIG. 8(*a*)-8(*d*). FIG. 8(*a*) represents a can-type combustor comprising a burner base 71, a swirler 73 and a combustor chamber 75 connected in series. The burner base 71 per se is shown in FIG. 8(*b*). Although shown hatched, the base is not completely solid, but contains passages for the supply of main and pilot fuel, etc. Accommodated in the burner base is a nozzle unit 77, which is shown in perspective view in FIG. 8(*c*). Liquid fuel is passed through the stem of the nozzle unit 77 and emerges from individual nozzles 79 formed in the nozzle face attached to the stem (see FIG. 8(*d*)). As with the FIG. 7 arrangement, these nozzles are inclined at at least a tilt angle, as can be seen from the orientation of the spray cones shown in FIG. 8(*d*). A combination of the interaction of neighbouring spray cones and the swirling air exiting the swirler 73 creates minor vortices, as shown by the arrows in FIG. 8(*d*). This provides more localized areas of mixing across the radial extent of the combustion chamber, leading to greater uniformity of mixing at the downstream end of the combustion chamber. It should be noted here that, although some of the spray cones appear directed toward the combustion-chamber wall, in practice little spray reaches this wall, since it is caught up in the spray of adjacent, inwardly facing nozzles.

Although not shown in FIG. 8(*d*), it is possible to employ swash as well as tilt in this arrangement, in order to enjoy some of the benefits arising from the use of swash in the earlier-described arrangements. In this case, the swash angles of the outwardly facing nozzles and those of the inwardly facing nozzles would be chosen, either by experiment or by computer simulation, or both, to provide the desired mixing behaviour overall. In order to obtain swash, it is necessary to employ nozzles which are offset from their respective swirler axes, after the manner of the first embodiment shown in FIGS. 4 and 5. The tilt and swash angles would correspond to those shown in FIG. 5 (where the swash angle is designated as angle $\beta$).

Instead of all of the nozzles shown in FIG. 8(*d*) being used simultaneously, as described above, they may be staged, as explained in connection with FIG. 7. Also, the tilt and/or swash angles of individual nozzles or groups of nozzles in both the FIG. 7 and FIG. 8 arrangements (and in the variant of FIG. 7) may be varied, in order to create a particular mixing effect. Again, the individual angles are readily determinable by experiment and/or computer simulation.

Figure 9A:
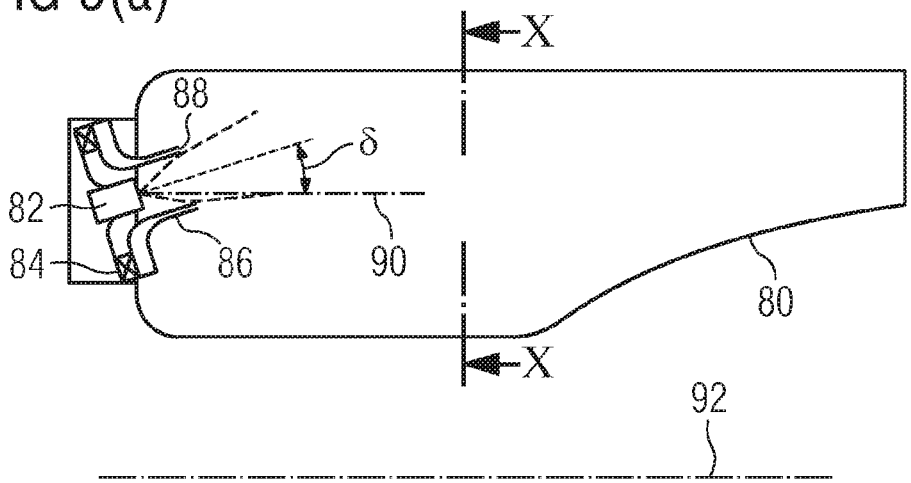
FIGS. 9(*a*)-9(*c*) are partial longitudinal sections of an annular combustor in accordance with a third embodiment of the present invention, in three variants thereof.
Figure 9B:
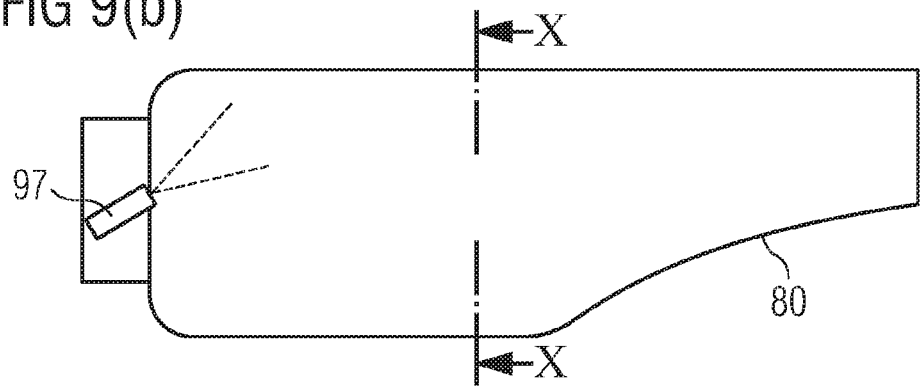
Figure 9C:
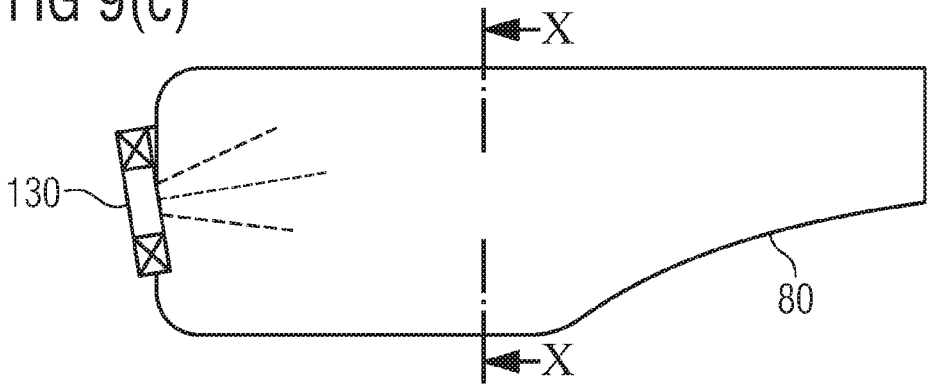
Figure 10A:
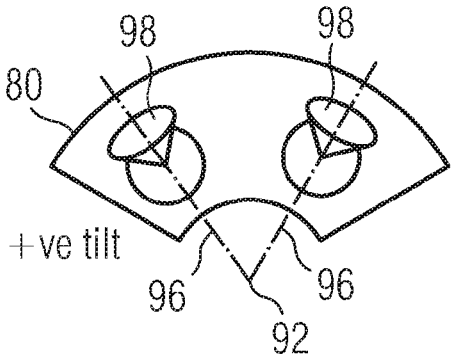
FIGS. 10(*a*)-10(*d*) are partial radial sections showing four different injector configurations in the combustor of FIGS. 9(*a*)-9(*c*), and FIG. 10(*e*) is a partial radial section showing the effect of the configuring of the injectors in the manner set forth in FIGS. 10(*a*)-10(*d*)
Figure 10C:
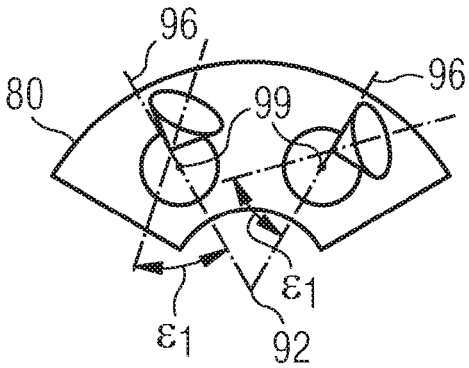
Figure 10B:
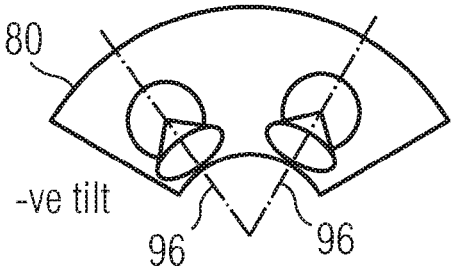
Figure 10D:
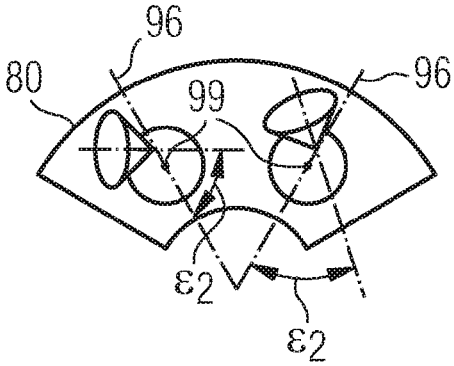
Figure 10E:
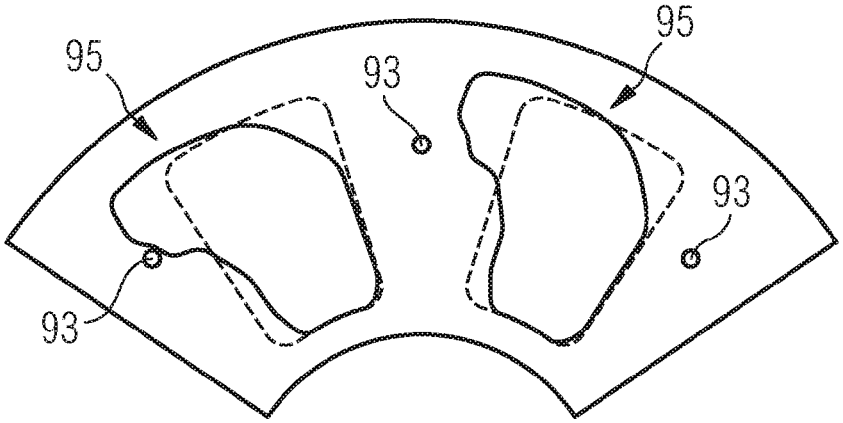

A third embodiment of the invention is illustrated in three variants thereof in FIGS. 9(*a*)-9(*c*). FIGS. 9(*a*)-9(*c*) show a longitudinal section of an annular-type combustor 80, in which a series of injectors is arranged around the dome of the combustor. FIGS. 10(*a*)-10(*d*) show a portion of the annulus in a radial section thereof, the portion including just two injectors in each case.

FIG. 9(*a*) uses as the injector a pre-filmer arrangement, in which each of the injectors is constituted by a nozzle 82 contained within a swirler 84. Adjacent the swirler on a downstream side thereof is a prefilmer device 86. The swirler and the prefilmer device are both annular in shape. In use, fuel is injected into the cylindrical space defined by the inside surface of the prefilmer device 86. The conical fuel spray emerging from the nozzle 82 strikes the inside surface of the prefilmer device and continues as a modified conical shape into the combustor itself. Air flowing from the swirler 84 is directed into the fuel stream and mixes therewith, at the same time helping to create secondary atomization at the lip 88 of the prefilming device.

The whole of the injector arrangement, including the nozzle 82, swirler 84 and prefilming device 86, is inclined at an angle to the dome wall, as shown. This inclination also forms an angle δ with a line parallel to the longitudinal axis of the combustor annulus. The longitudinal axis is represented by the line 92, which lies parallel to the line 90 passing through the radial mid-point of the annulus section (the distances are not shown to scale). Consequently, the fuel-air mixture is directed toward a part of the combustor, which will provide for an enhanced combustion. More specifically, the tilting shown as angle δ influences the recirculation zones around the area when the fuel is injected into the combustor from the nozzle 82 and prefilmer 86. This, in turn, can provide increased stability or modulate any combustor-driven dynamics (including acoustic pulsations in the whole combustor system. Note also that the spray from the nozzle 82 and prefilmer 86 can be injected radially off-centre between the outer and inner combustion-chamber walls, instead of substantially on-centre, as shown.

The inclination of the injector assembly 82-88 corresponds to the positive tilt configuration shown in FIG. 10(*a*). In this configuration the major axes 96 of the fuel cones 98 pass through the centre of the combustor annulus, which is the afore-mentioned longitudinal axis 92 of the combustor. Where necessary, in order to enhance the combustion process, the tilt angle may be negative, as shown in FIG. 10(*b*). Again, the major axes 96 will pass through the longitudinal axis 92. Where, as mentioned in the last paragraph, the fuel injection point is radially off-centre between the inner and outer walls of the annular combustion chamber, the tilt angle may be deliberately chosen so as to direct the spray cones more toward the radial centreline between the two combustion-chamber walls, in the manner of the first embodiment (FIG. 4).

In addition to using tilt, the swash described earlier in connection with the first embodiment may be employed. This is illustrated in FIGS. 10(*c*) and 10(*d*), in which it can be seen that the spray cones originate from a point (the nozzle exit point), which is offset from the longitudinal axes 99 of the respective swirlers, as in the manner of the first embodiment (FIGS. 4 and 5). In FIG. 10(*c*) positive tilt is combined with positive swash (angle ϵ1), while in FIG. 10(*d*) positive tilt is combined with negative swash (angle ϵ2), the swash angles being relative to the unswashed major axes 96.

The spray profile in the case of positive swash (FIG. 10(*c*)) is shown in FIG. 10(*e*). FIG. 10(*e*) is an end-view corresponding to that of FIG. 10(*c*), but from the opposite side. Thus, the nozzles themselves are shown as item 93, while the spray profile is shown as item 95. The distribution shown by dashed lines is the distribution applicable to the untilted and unswashed nozzles, whereas that shown by the solid lines applies to the tilted and swashed nozzles. The skewing of the distribution is clearly apparent, and can be beneficial in as much as it can adjust the combustor exit profile, i.e. the fuel-air mixing behaviour as viewed over the whole radial extent of the combustor at its output end.

The advantages of positive and negative swash in this embodiment are the same as those mentioned earlier in connection with the first embodiment and apply also to the second embodiment.

Figure 11:
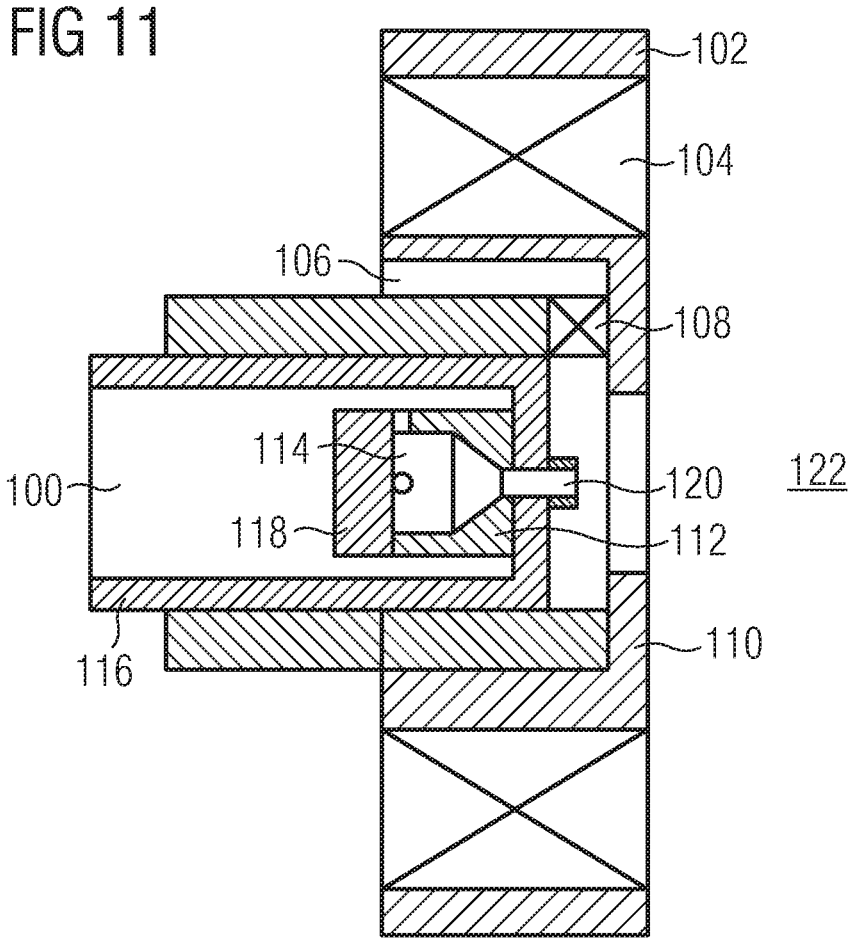
FIG. 11 is an axial section through a pressure-swirl type of injector that may be employed in a combustor in accordance with the present invention.

Two variants of the FIG. 9(*a*) arrangement are illustrated in FIGS. 9(*b*) and 9(*c*). In FIG. 9(*b*) the prefilmer-type injector is replaced by a so-called pressure-swirl injector arrangement 97. An example of a pressure-swirl injector is depicted in FIG. 11. This pressure-swirl injector, which is derived from US 2006/0042254, filed in the name of Yoshida, Shouhei, et al., comprises a liquid-fuel nozzle 100 and a combustion burner 102. The burner 102 includes a swirler 104, an air nozzle 106, a further swirler 108 and a guide ring 110. The liquid-fuel nozzle 100 comprises a nozzle tip 112 in communication with a swirl chamber 114, a nozzle cover 116, a nozzle stay 118 and an outlet 120. The dome end of the combustion chamber 80 in FIG. 9(*b*) is shown in FIG. 11 as region 122. The operation of this particular injector is described in US 2006/0042254, which is incorporated herein by way of reference, and will not be gone into in detail here, except to say that the air nozzle 106 directs the air passing through it toward the axis of the liquid-fuel nozzle 100, forming a space around the outlet 120, through which liquid fuel is injected from the nozzle 100 into the combustion chamber 122. This enables carbonaceous deposits on the surrounding surfaces of the liquid-fuel nozzle outlet to be suppressed regardless of the operating conditions of the combustor.

As with the FIG. 9(*a*) case, the whole of the injector 97 is inclined by tilt and, where desired, swash with respect to the combustor 80.

Figure 12B:
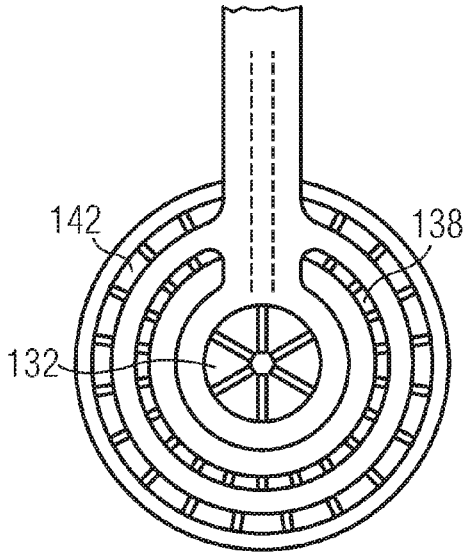
FIGS. 12(*a*) and 12(*b*) are longitudinal and radial sections, respectively, of an air-blast type of injector that may be employed in a combustor in accordance with the present invention.
Figure 12A:
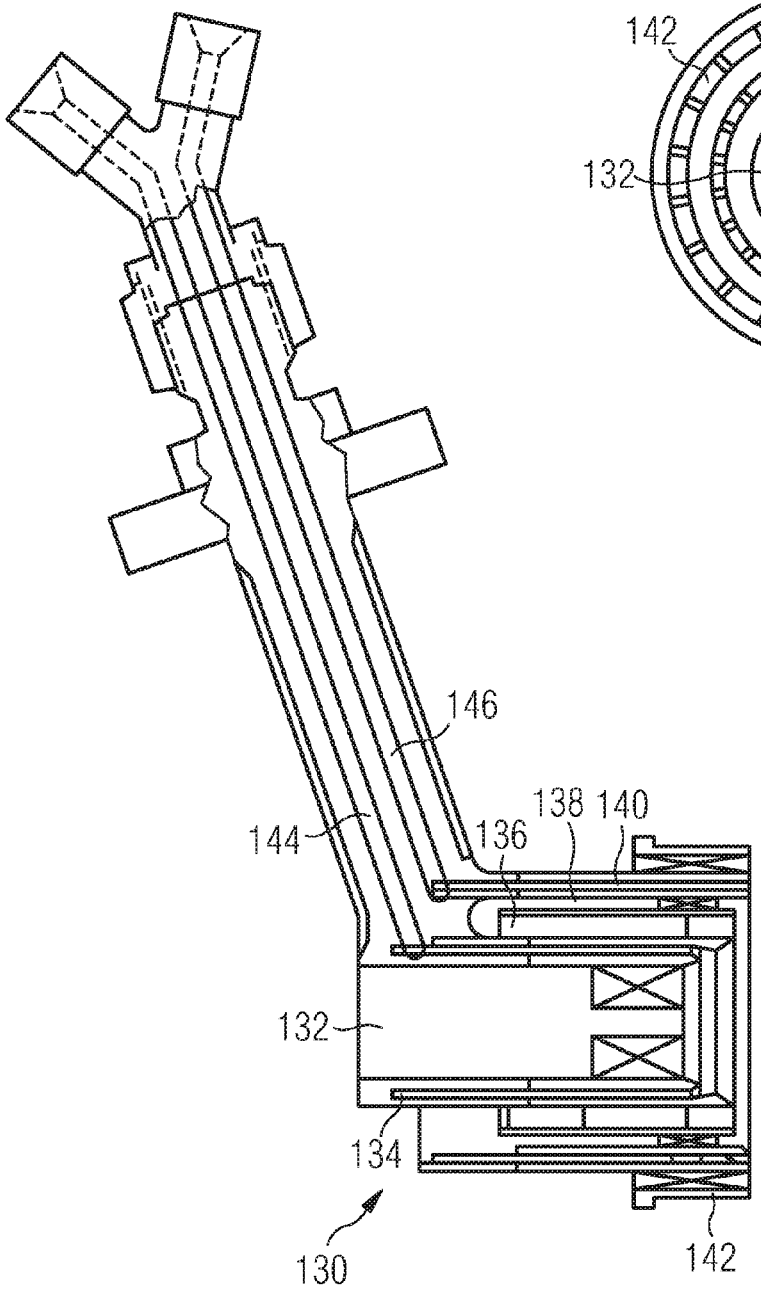

The second variant employs an air-blast injector arrangement, which is shown purely representationally in FIG. 9(*c*) as item 130. FIGS. 12(*a*) and 12(*b*) give an example of such an injector arrangement and are taken from U.S. Pat. No. 6,662,565, issued to Brundish, K. D., et al. The injector comprises a nozzle 130 having an inner swirler 132, an inner fuel filmer 134, an air filmer 136, an outer swirler 138, an outer fuel filmer 140 and an outermost swirler 142. Fuel supply channels 144 and 146 supply fuel to the inner and outer fuel filmers, respectively. In use, the air passing through the swirlers interacts with the fuel to atomize the latter and provide two separate air-fuel flows into the combustor, to which the injector is mounted. In the illustrated example the two flows are main and pilot flows. Other designs are available, which cater for one or the other of these flows.

As with the FIGS. 9(*a*) and 9(*b*) arrangements, the variant shown in FIG. 9(*c*) may employ swash as well as tilt. In addition, the fuel nozzles may either all be of the same type, or be of different types.

Figure 13:
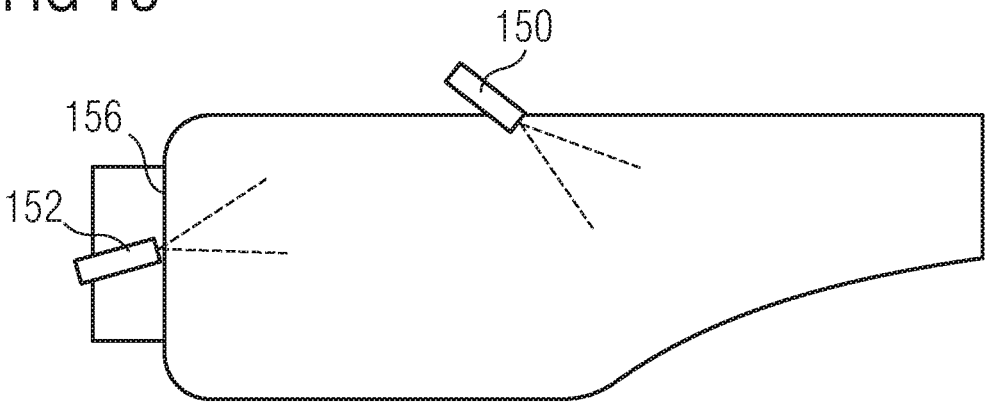
FIGS. 13 and 14 are partial longitudinal sections of an annular combustor in accordance with the present invention and including, respectively, axially and radially staged injectors.
Figure 14:
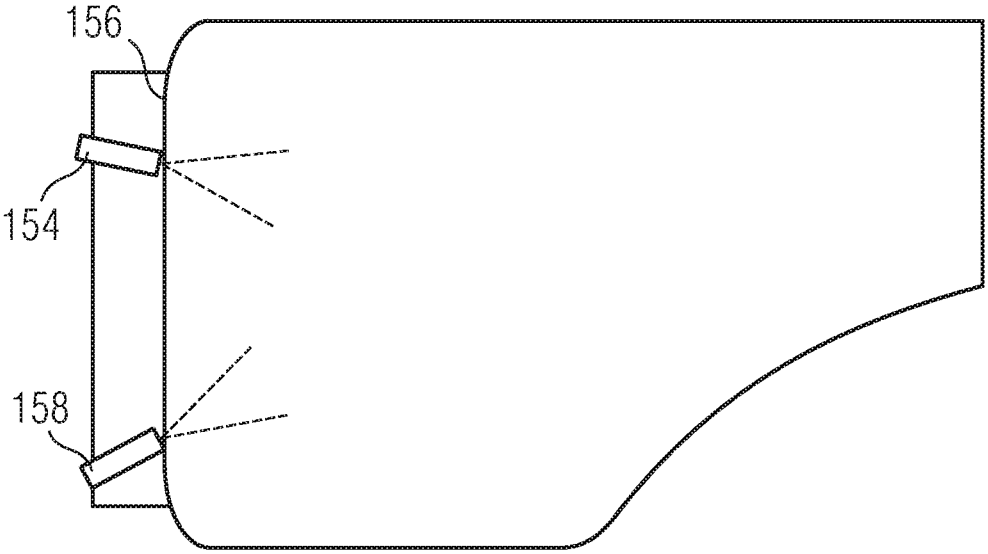

The use of tilt and, as desired, swash can be extended to an axially staged or radially staged annular combustor. FIGS. 13 and 14 show an example of these. In FIG. 13 a secondary fuel bank 150 is included along with the primary fuel bank 152, which may take the form of any of the variants shown in FIGS. 9(*a*)-9(*c*) and is located at the dome end 156. By tilting the primary injectors 152 toward the radially outer wall of the combustor in the manner shown, the ignition of the secondary fuel bank 150 can be enhanced, without the need for complex cross-firing tubes or special igniters. As with the FIG. 9 embodiment, swash may also be employed along with tilt, in order to improve combustion.

Figure 1A:
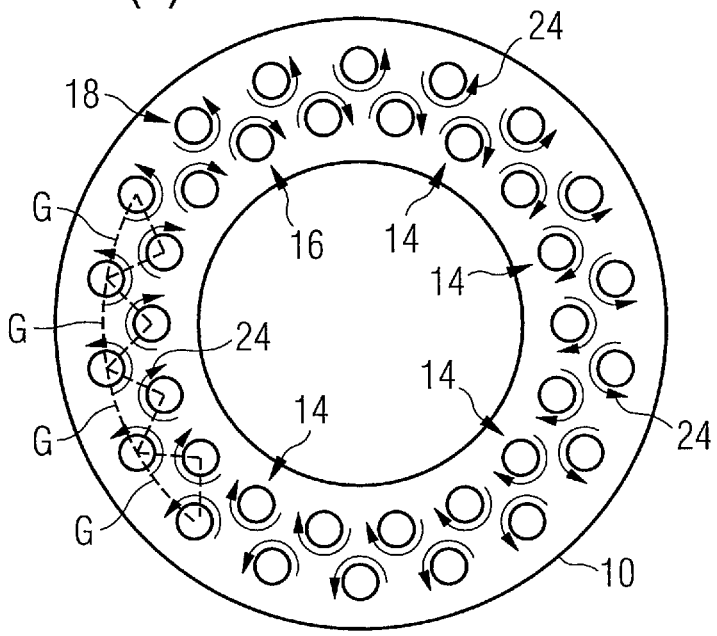
FIG 1(a) PRIOR ART
FIGS. 1(*a*) and 1(*b*) are, respectively, a radial section and a partial longitudinal section through a known annular combustor.
Figure 1B:
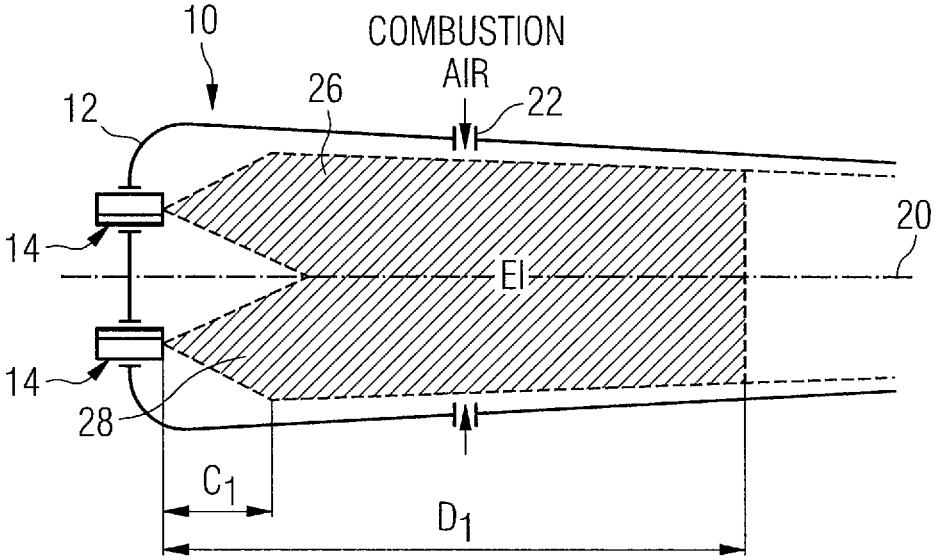
FIG 1(b) PRIOR ART
Figure 2A:
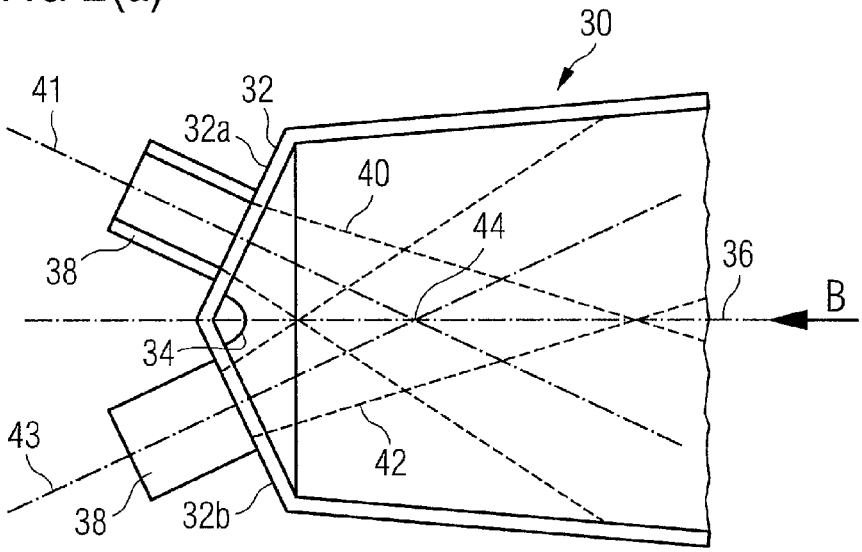
FIG 2(a) PRIOR ART
FIGS. 2(*a*) and 2(*b*) are, respectively, a partial longitudinal section and a partial radial section through a further known annular combustor.
Figure 2B:
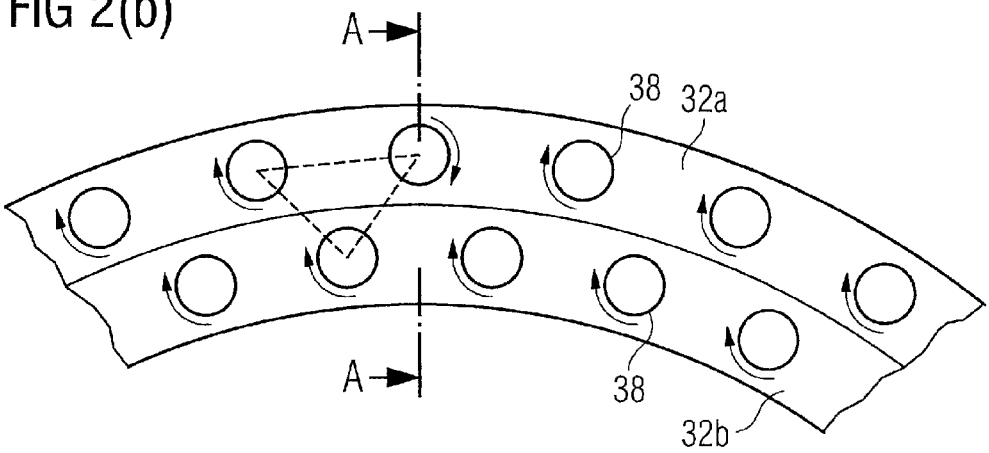
FIG 2(b) PRIOR ART

FIG. 14 shows an annular combustor, in which two rows of injectors 154, 158 are disposed spaced radially apart on the dome part 156 of the combustor. The injectors 154 and 158 may be interleaved, as shown in FIG. 1, or they may be disposed directly opposite each other. Whichever configuration is used, the injectors of one row are inclined toward the injectors of the other row. This likewise helps to improve the cross-firing between the injector banks, as in the FIG. 11 case.

In both the FIG. 13 and FIG. 14 arrangements, the injector banks 152, 154 and 156 are inclined as shown without requiring the dome end 156 of the combustor to be similarly inclined. Thus, these arrangements are similar to those shown in FIGS. 9(*a*)-9(*c*). Also similar to FIGS. 9(*a*)-9(*c*), the additional injector banks may all be of the same type, or of different types.

Figure 15A:
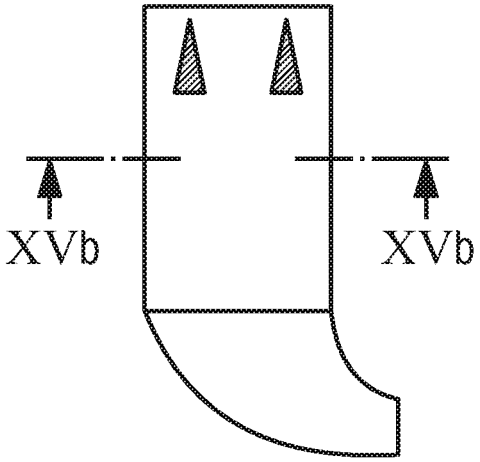
FIGS. 15(*a*) and 15(*b*) are longitudinal and radial sections, respectively, of a silo combustor employing injector tilt.
Figure 15B:
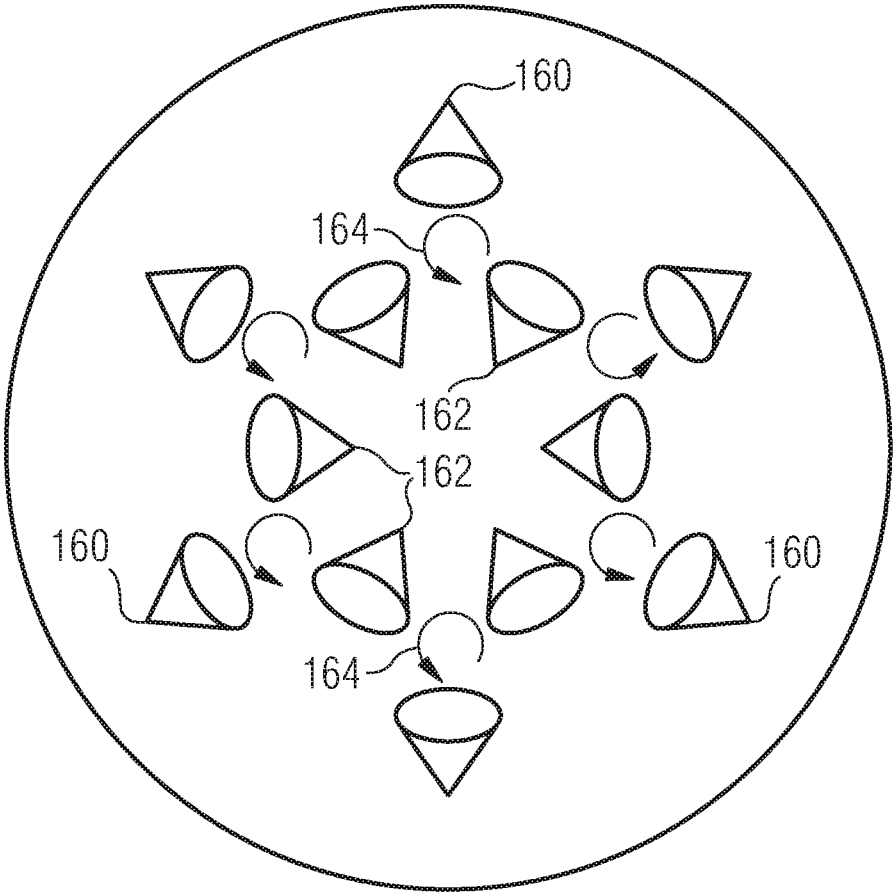

Tilt may also be used with the injectors of a silo-type combustor. A simplified representation of such a combustor is shown in FIG. 15(*a*). FIG. 15(*b*) is an end-view of the same combustor. The injectors 160, 162, from which the fuel cones can be seen to emanate, are configured in two concentric rows—an outer row including injectors 160 and an inner row including injectors 162. The injectors of one row are staggered with respect to the injectors of the other row, in order to promote the generation of recirculation zones (see arrows 164). The injectors are also tilted, cross-firing between the injectors being thereby improved. As in previous embodiments, the nozzles 160, 164 may also be rotated through a swash angle, provided the nozzles are offset from the longitudinal axes of their respective swirlers.

The invention claimed is:

1. A combustor for a gas-turbine engine, comprising:

a burner head;

a combustion chamber disposed downstream of the burner head;

a swirler for creating a swirling flow of air in the combustion chamber; and a plurality of fuel nozzles disposed in the burner head for supplying fuel to the combustion chamber, wherein each of the plurality of fuel nozzles is disposed in the burner head such as to give rise to a first angle of exit of the fuel from a downstream face of the burner head with respect to a longitudinal axis of the combustor, the first angle being unequal to 0° such that the fuel nozzle is tilted toward the longitudinal axis, wherein the first angle lies in a first plane passing through the longitudinal axis, wherein each of said plurality of fuel nozzles is disposed in the burner head such as to also give rise to a second angle of exit of the fuel from the downstream face with respect to the first plane, the second angle being greater than or less than 0°, and wherein the second angle lies in a second plane orthogonal to said first plane, and wherein the first angle and second angle varies between individual fuel nozzles of the plurality of fuel nozzles or between groups of said plurality of fuel nozzles.

2. A combustor as claimed in claim 1, wherein at least one of the plurality of fuel nozzles is configured such as to give rise to a generally cone-shaped spray of fuel entering the combustion chamber, and wherein a third angle between a surface of the cone-shaped spray of fuel and the downstream face is >0°.

3. A combustor as claimed in claim 1, wherein a third angle between a surface of a cone-shaped spray of the fuel and the downstream face is 0°.

4. A combustor as claimed in claim 2, wherein the combustor is a can-type combustor and the plurality of fuel nozzles is disposed radially offset from the longitudinal axis of the combustor.

5. A combustor as claimed in claim 4, wherein the first angle is such that the cone-shaped spray of fuel is inclined toward the longitudinal axis of the combustor.

6. A combustor as claimed in claim 5, wherein a duct forming part of at least one of the plurality of fuel nozzles is angled.

7. A combustor as claimed in claim 6, wherein only an end portion of the duct is angled.

8. A combustor as claimed in claim 6, wherein the whole duct is angled.

9. A combustor as claimed in claim 2, wherein the combustor is an annular combustor comprising the plurality of fuel nozzles disposed in a circumferentially spaced apart manner.

10. A combustor as claimed in claim 9, wherein at least one of the plurality of fuel nozzles is a pre-filmer device comprising a fuel duct, a swirler and a pre-filmer element, all of which are disposed at the first and the second angles.

11. A combustor as claimed in claim 9, wherein at least one of the plurality of fuel nozzles is a pressure-swirl injector device comprising a swirler and a fuel duct, both of which are disposed at the first and the second angles.

12. A combustor as claimed in claim 9, wherein at least one of the plurality of fuel nozzles is an air-blast injector device comprising two or more coaxially disposed swirlers and filming elements, all of which are disposed at the first and the second angles.

13. A combustor as claimed in claim 9, further comprising a first further fuel nozzle disposed axially downstream of the plurality of fuel nozzles, the plurality of fuel nozzles being disposed such as to direct a flow of fuel toward the first further fuel nozzle.

14. A combustor as claimed in claim 9, further comprising a second further fuel nozzle disposed in the burner head radially inwardly or radially outwardly of the plurality of fuel nozzles, the plurality of fuel nozzles being disposed such as to direct the flow of fuel toward the second further fuel nozzle.

15. A combustor as claimed in claim 1, wherein at least one of the plurality of fuel nozzles is a pilot-fuel nozzle.

16. A combustor for a gas-turbine engine, comprising:

a burner head;

a combustion chamber disposed downstream of the burner head;

a swirler for creating a swirling flow of air in the combustion chamber; and a plurality of fuel nozzles disposed in the burner head for supplying fuel to the combustion chamber, wherein each of the plurality of fuel nozzles is disposed in the burner head such as to give rise to a first angle of exit of the fuel from a downstream face of the burner head with respect to a longitudinal axis of the combustor, the first angle being unequal to 0°, wherein the first angle lies in a first plane passing through the longitudinal axis, wherein each of said plurality of fuel nozzles is disposed in the burner head such as to also give rise to a second angle of exit of the fuel from the downstream face with respect to the first plane, the second angle being unequal to 0°, wherein the second angle lies in a second plane orthogonal to said first plane, wherein individual fuel nozzles of the plurality of fuel nozzles have different first angles and different second angles, wherein at least one of the plurality of fuel nozzles is a pilot fuel nozzle supplying only pilot fuel to the combustion chamber, the pilot fuel nozzle being disposed off-center with respect to the longitudinal axis, and wherein the first angle is configured so as to direct pilot fuel from the pilot fuel nozzle toward the longitudinal axis.

* * * * *